United States Patent [19]

Borofsky

[11] Patent Number: 4,998,314

[45] Date of Patent: Mar. 12, 1991

[54] COMBINATION OF A BONNET AND A BASE MEMBER FOR A ROTARY CLEANING MACHINE

[75] Inventor: Gary R. Borofsky, Rydal, Pa.

[73] Assignee: Bonnit Brush Systems Co., Huntingdon Valley, Pa.

[21] Appl. No.: 349,689

[22] Filed: May 10, 1989

[51] Int. Cl.[5] ..... A47L 11/14; A47L 11/162

[52] U.S. Cl. ..... 15/4; 15/180; 15/230; 15/230.16; 15/49.1

[58] Field of Search ..... 15/49 R, 50 R, 98, 4, 15/230, 230.14, 230.16, 230.17, 230.19, 246, 385, 180

[56] References Cited

U.S. PATENT DOCUMENTS

| | | | |
|---|---|---|---|
| 2,000,931 | 5/1935 | De Nagy | 15/49 R |
| 3,047,897 | 8/1962 | Bartos et al. | 15/49 R X |
| 3,115,660 | 12/1963 | Hunt | 15/230 |
| 3,181,193 | 5/1965 | Nobles et al. . | |
| 3,290,713 | 12/1966 | Barry | 15/180 |
| 3,795,932 | 3/1974 | Young | 15/98 |
| 4,219,898 | 9/1980 | Presby | 15/49 R |
| 4,391,548 | 7/1983 | Malish . | |
| 4,418,438 | 12/1983 | Cutler | 15/98 X |
| 4,491,999 | 1/1985 | Babcock | 15/98 X |
| 4,502,174 | 3/1985 | Rones | 15/98 |
| 4,541,207 | 9/1985 | Antonson | 15/230.17 |

*Primary Examiner*—Edward L. Roberts

*Attorney, Agent, or Firm*—Panitch, Schwarze, Jacobs & Nadel

[57] ABSTRACT

A combination of a bonnet and a base member used in connection with a rotary cleaning machine. The combination includes a base member for attachment to a drive shaft of a rotary cleaning machine. A brush member is releasably positioned on the base member. The combination further includes a bonnet constructed of flexible material which includes an opening correspondingly sized and located to receive the brush member therethrough. The bonnet is positioned on the base member such that the brush member extends through the bonnet opening to form a cleaning surface by the combination of the brush member and bonnet. This arrangement allows the brush member and bonnet to be independently replaceable.

16 Claims, 2 Drawing Sheets

COMBINATION OF A BONNET AND A BASE MEMBER FOR A ROTARY CLEANING MACHINE

FIELD OF THE INVENTION

The present invention relates to cleaning bonnets and, more particularly, to a combination of a bonnet and a base member containing a bristle brush member for a rotary floor cleaning machine used for cleaning carpets.

BACKGROUND OF THE INVENTION

In the maintenance of carpeted floors, a variety of power-driven implements have been utilized to facilitate scrubbing and cleaning of relatively large carpeted areas. One popular machine for such maintenance work is a rotary scrubbing machine. Such a machine is shown in FIG. 1 and generally includes an electric motor, a handle extending at an angle upwardly toward the operator from a motor housing, a holding tank, which contains cleaning fluid, positioned on or above the motor housing and a scrubbing, polishing disk or base member attached to the motor drive shaft beneath the motor.

The disk or base member usually includes a cleaning pad or bonnet disposed thereon. This bonnet bears directly on the floor or carpet and applies the cleaning fluid thereto. The combined rotational, lateral and forward movement of the bonnet performs the cleaning and scrubbing action.

Conventional bonnets are more or less of a mop-like or shag-like consistency in that the surface which bears on the carpet is relatively soft and yielding. The trouble with such conventional bonnets is that they lack the aggressive stripping and scrubbing fibers which are necessary to perform an effective cleaning action. Such conventional bonnets are about as effective as using a standard mop over the surface of a rug, no worthwhile deep cleaning action is achieved.

More recently, bonnets have been provided with firmer surfaces. These bonnets are made by tightly looping strands of strong synthetic material through a base sheet of material. The resulting bonnet is much like a hooked rug as its working surface is quite firm. The firmer surface is advantageous in that it actively cleans the carpet and loosens a considerable amount of dirt which is lodged deep in the carpet or rug. However, these bonnets are problematic because they do not efficiently absorb the loosened dirt.

Other more recent bonnets have included generally radially disposed strips of fibers which are more like the consistency of conventional hair brushes. Such fibers possess an even better scrubbing action, but they also lack the feature of picking up and retaining the dirt which is released from the rug or carpet.

Still other bonnets combine the above features by providing a basically firm and fabricated-like hooked rug which includes radial strips of fibers and arcuate strips of fibers close to the circular edge of the bonnet. These fibers serve a scrubbing purpose and the firm, hooked-rug-like portion of the bonnet serves to further scrub the floor or carpet and, at the same time, serves to absorb and retain some of the dirt which is released from the floor or carpet.

The disadvantages in such combination cleaning bonnets is inherent in the fact that different materials are used on the face of the bonnet. Since different materials are used, the life of the bonnet is directly attributable to the material which wears out first. Consequently, a need arose for a bonnet wherein the different materials could be independently changed to thereby increase the life of the bonnet. Additional disadvantages with the conventional cleaning bonnets is that since they are rotated in only one direction, the bonnets tend to wear or become matted down in one direction, thereby decreasing the cleaning efficiency of the bonnet. Therefore, a need has arisen wherein the life of the bonnet can be increased.

SUMMARY OF THE INVENTION

Briefly, stated, the present invention comprises a combination of a bonnet and a base member for a rotary cleaning machine. The combination comprises a base member for attachment to a drive shaft of the rotary cleaning machine. A brush member is releasably positioned on the base member. A bonnet is constructed of flexible material and includes an opening correspondingly sized to receive the brush member therethrough. The bonnet is positioned on the base member such that the brush member extends through the bonnet opening, whereby a cleaning surface is formed by the brush member and bonnet and wherein the brush member and bonnet are independently replaceable.

BRIEF DESCRIPTION OF THE DRAWINGS

The foregoing summary, as well as the following detailed description of the preferred embodiment, are better understood when read in conjunction with the appended drawings. For the purpose of illustrating the invention, there is shown in the drawings an embodiment which is presently preferred, it being understood, however, that the invention is not limited to the specific methods and instrumentalities disclosed. In the drawings.

DESCRIPTION OF THE PREFERRED EMBODIMENT

Figure 1:
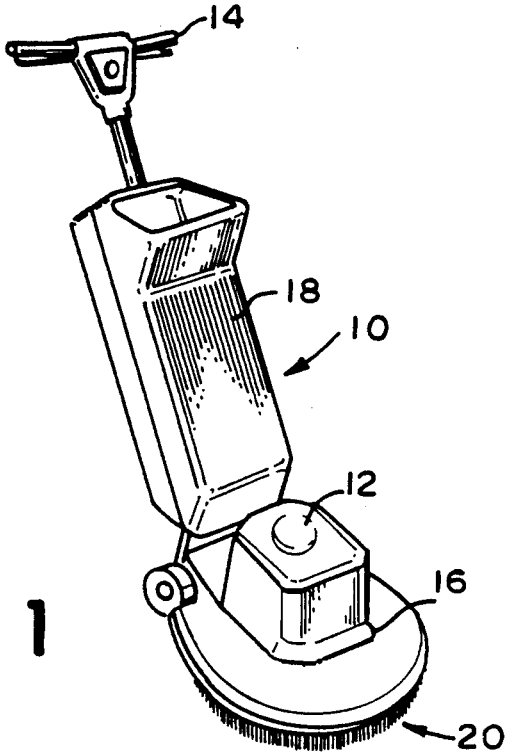
FIG. 1 is a perspective view of a typical rotary floor cleaning machine used in connection with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the bonnet and base member and designated parts thereof. The terminology includes the words above specifically mentioned, derivatives thereof and words of similar import.

Referring to the drawings in detail, wherein like numerals indicate like elements throughout, there is shown in FIGS. 1 through 4 a preferred embodiment of a bonnet and base member in accordance with the present invention.

FIG. 1 illustrates a typical rotary floor cleaning machine 10 used in connection with cleaning carpets The rotary floor cleaning machine 10 includes an electric motor 12 and a handle 14 extending at an angle upwardly toward the operator (not shown) from a motor housing 16. A holding tank 18, which contains a liquid cleaning fluid or other such material, is mounted above the motor housing 16. Operatively associated with the floor cleaning machine 10 is a combination, bonnet and a base member (generally designated 20) as described in detail hereinafter.

In the presently preferred embodiment, rotary floor cleaning machine 10 is of the slow speed, swing type having a standard one horsepower electric motor. Such a machine is capable of receiving bonnets having a fifteen to twenty-inch diameter. However, it is understood by those skilled in the art that the present invention is applicable to any type of rotary cleaning machine. For instance, the present invention could be used in connection with smaller sized, hand-held rotary cleaning machines for spot cleaning or with other types of commercially available machines, such as a standard floor buffer machine.

The specific and pertinent parts of the rotary cleaning machine 10 itself are not relevant to the present invention and are understood by those skilled in the art. Therefore, for convenience only, further description of the rotary cleaning machine itself is unnecessary.

For ease of description and convenience only, the following description pertains to the use of four brush members in connection with the present invention and is not limiting. It is understood by those skilled in the art that a single brush member or a different number of brush members can be used in connection with the present invention, without departing from the spirit and scope of the invention, as described hereinafter.

Figure 3:
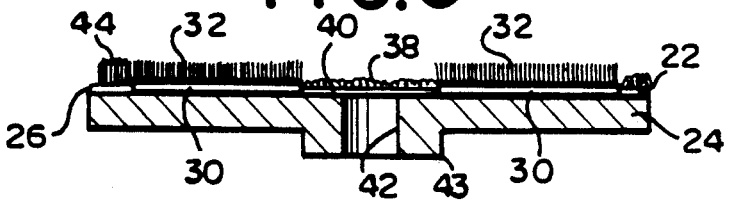
FIG. 3 is a sectional view of the bonnet and base member of FIG. 2 taken along line 3-3 of FIG. 2.
Figure 4:
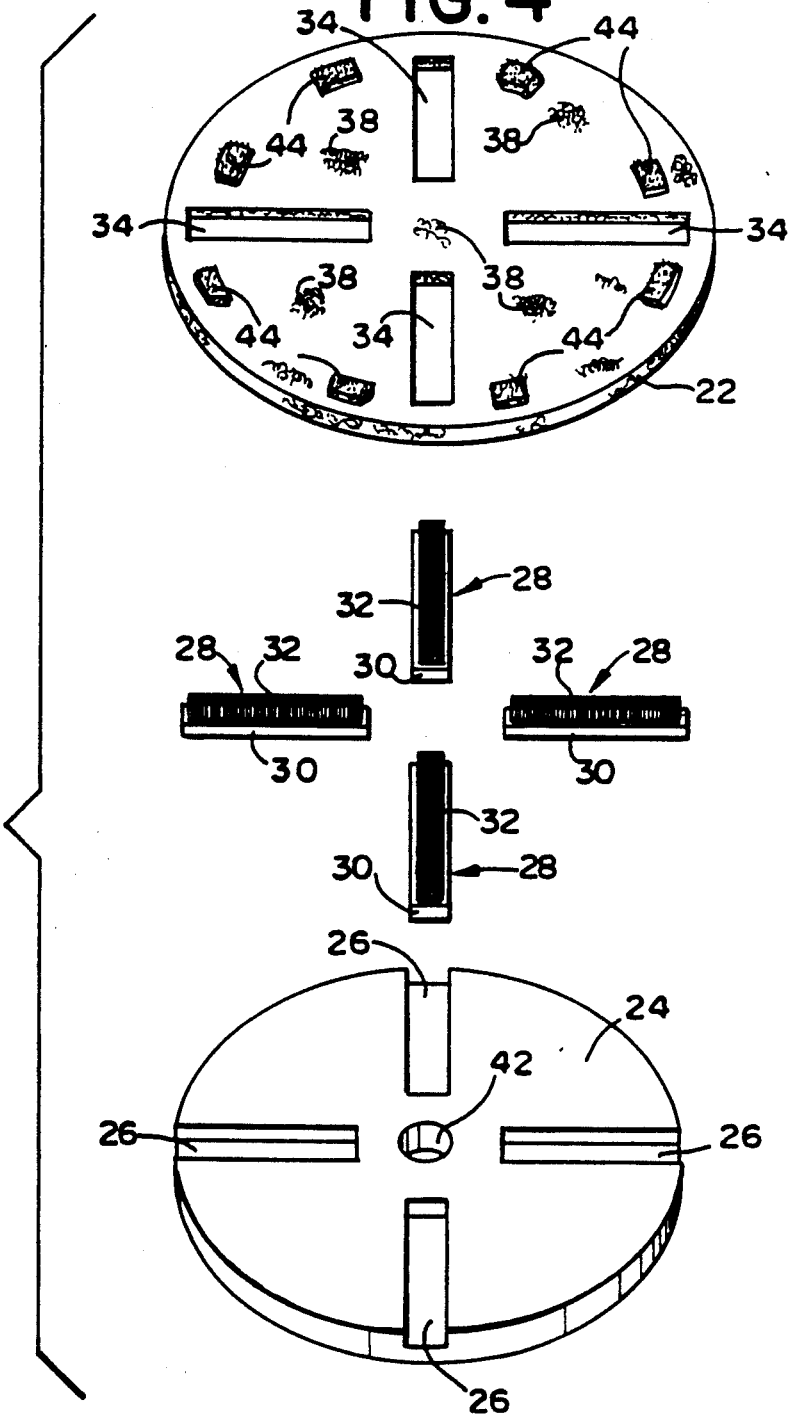
FIG. 4 is an exploded perspective view of the bonnet and base member in accordance with the present invention.

Referring now to FIGS. 3 and 4, a combination of a bonnet 22 and base member 24 on which the bonnet 22 is positioned is shown. Preferably, the bonnet 22 and base member 24 are used in connection with a rotary cleaning machine, such as that shown in FIG. 1. However, as mentioned previously, it is understood by those skilled in the art that the present invention can be used in connection with any type of rotary cleaning machine or rotary drive system, such as a portable hand-operated rotary cleaning machine (not shown).

As shown in FIGS. 3 and 4, a universal block or base member 24 is provided for attachment to a drive shaft (not shown) of the rotary cleaning machine 10. Preferably, the base member 24, which may be used for both hard and soft surfaces, is generally disk-shaped with a generally circular circumference. In the presently preferred embodiment, the base member 24 is fabricated from laminated plywood with a thickness of approximately one inch. However, the base member could be made of some other material, such as metal or polymeric material and could be of any other thickness, as desired. The base member 24 includes a generally cylindrical mounting hole 42 and riser 43 located generally in the center thereof. The mounting hole 42 provides the means for securing the base member 24 to the drive shaft of the rotary floor cleaning machine 10. The mounting hole 42 and riser 43 cooperate with the drive shaft so that upon operation of the motor the motor drive shaft causes the base member 24 to rotate in a manner known to those skilled in the art. The specifics of precisely how the base member 24 is secured to the rotary cleaning machine 10 are not pertinent to the present invention, therefore further description thereof is not necessary.

As shown in FIG. 4, a first surface of the base member 24 includes at least one generally radially extending groove 26. In the presently preferred embodiment, a plurality of radially extending grooves 26 are circumferentially spaced around the first surface of the base member 24. Specifically, in the preferred embodiment, the base member 24 includes four such radially extending grooves spaced equidistantly (approximately 90° apart) around the circumference of the first surface of the base member 24. However, it is understood by those skilled in the art that base member 24 may include any other number of such radially extending grooves, such as one, two, three, six or eight. It is also understood by those skilled in the art that the grooves 26 may be positioned on the first surface of the base member 24 in any other suitable array or geometrical configuration, such as octagonal and that they need not be radially extending.

In the presently preferred embodiment, the grooves 26 are generally rectangular in cross section and have a depth equal to approximately one-half the thickness of the base member 24. However, it is understood by those skilled in the art that the grooves 26 may be of any shape, thickness, depth or form, without departing from the spirit and scope of the invention. For instance, the grooves 26 can be in the form of a dovetail slot (not shown).

Referring now to FIGS. 3 and 4, at least one brush or cleaning member 28 is releasably positioned on the base member 24. The brush member 28 includes a back portion 30 and a plurality of bristles 32 extending outwardly therefrom. The back portion 30 is releasably attached or secured to the base member 24. Specifically, the back portion 30 is releasably positioned within a groove 26.

In the presently preferred embodiment, the back portion 30 is suitably sized and shaped to correspondingly friction fit within the grooves 26 to thereby allow the brush member to be releasably positioned within the groove 26. However, it is understood by those skilled in the art, that the back portion 30 can cooperate with the base member 24 in any other fashion or manner such that the brush member 28 is releasably positioned on the base member 24. For instance, back portion 30 and groove 26 can be correspondingly sized and shaped in the form of a standard dovetail arrangement to allow the brush member 28 to be slidably positioned within the groove 26. Other means may be used for releasably securing the brush member 28 to the base 24, such as thumb screws, latches, clips or the like, without departing from the spirit and scope of the invention.

In the presently preferred embodiment, the back brush member portion 30 is constructed of a material such as wood which can securely receive the bristles 32 in a cantilever fashion. However, as is understood by those skilled in the art, back portion 30 can be constructed of any suitable material, such as a polymeric material. Furthermore, in the presently preferred embodiment, the bristles 32 are of a material such as "NYLON," having sufficient structural integrity or consistency to provide aggressive cleaning action to thereby dislodge dirt or foreign matter deep within the carpet. However, it is also understood by those skilled in the art that bristles 32 can be constructed of other natural or synthetic materials, such as horse hair or a polymeric material, without departing from the spirit and scope of the invention.

It is understood by those skilled in the art that brush member 28 is reversibly mounted on base member 24. That is, brush member 28 can be positioned within the groove 26 in one of two positions. Therefore, when the bristles 32 become matted or worn, due to rotation of the base member 24 in one direction, the brush member 28 can be removed from the groove 26, turned 180° and repositioned within the groove 26. This allows the matted down bristles to be repositioned in a direction counter to the rotational direction of the. machine to provide improved efficiency and an enhanced service life for the brush member.

In the presently preferred embodiment, base member 24 is provided with four brush members 28, each correspondingly size and shaped to fit within one of the four grooves 26 in the first surface of the in base member 24. However, it is understood by those skilled in the art that any other number of brush members 28 can be used in conjunction with a corresponding number of grooves 26 within the base member 24, such as two, three, six or eight, without departing from the spirit and scope of the invention. In addition, it is possible that in some circumstances, the number of brush members used could be less than the number of grooves, i.e., six grooves with three brush members.

Figure 2:
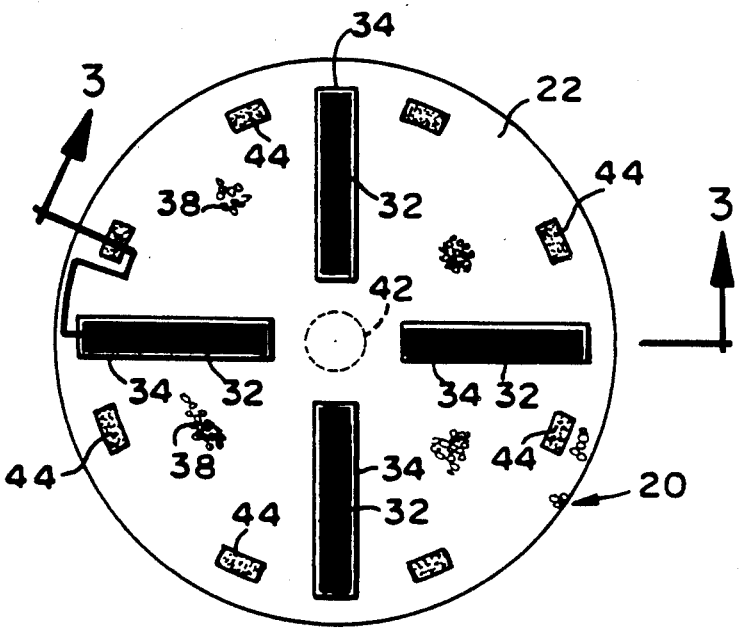
FIG. 2 is a bottom plan of a bonnet and base member in accordance with the present invention.

Referring now to FIGS. 2 and 4, the bonnet 22 is constructed of a flexible material and includes at least one opening 34 correspondingly sized to receive a brush member 28 therethrough. The bonnet 22 is positioned on the base member 24 such that the brush member 28 extends through the bonnet opening 34, whereby a cleaning surface 36 is formed by the combination of the brush member 28 and bonnet 22. The bonnet 22 is secured to the base member 24 in a manner known to those skilled in the art, and, preferably, is simply laid on the base member 24 without the use of additional attachment means. If desired, the base member 24 may include a plurality of outwardly extending bonnet grippers (not shown) of a type known in the art. With such an arrangement, the brush member 28 and bonnet 22 are independently replaceable.

In the presently preferred embodiment, the bonnet 22 is generally circular and the flexible material is formed of a bed of firmly looped, flexible strands of material 38 secured to a flexible base sheet or backing material 40. In the presently preferred embodiment, the flexible backing material 40 is a strong, non-woven fabric, such as burlap or a burlap-like synthetic fabric. However, it is understood by those skilled in the art that the flexible backing material 40 can be constructed of any firm and tightly constructed material, such as canvas, to retain the flexible strands of material 38, which are looped back and forth through it, to thereby form a pile of flexible strands of material 38. Preferably, the flexible strands of material 38 are of strong, tough synthetic material, such as a polymeric material, which can withstand the wear and tear of rubbing on the surface to be cleaned.

In the presently preferred embodiment, the bonnet 22 is provided with four openings 34, each correspondingly sized and shaped to receive one brush member 28 therethrough. However, it is understood by those skilled in the art that the bonnet 22 can include any other number of openings used in conjunction with a corresponding number of brush members 28 and grooves 26, such as one, two, three, six or eight, without departing from the spirit and scope of the invention.

As shown in FIG. 4, the openings 34 are generally rectangular in shape and extend generally radially and are correspondingly circumferentially spaced and sized to receive the bristles 32 of the brush member 28 therethrough It is understood by those skilled in the art that openings 34 can be sized and positioned on bonnet 22 in any fashion, so long as the openings 34 correspond and complement the bristles 32 on the base member 24. Preferably, the bristles 32 extend beyond the first surface of the base member 24 a distance which generally corresponds to the thickness of the bonnet 22, such that the ends of the bristles 32 and the cleaning surface of the bonnet 22 are generally coplanar. That is, the bonnet 22 is positioned on the base member 24 such that the bristles 32 extend through the opening 34 to thereby form a cleaning surface of firmly looped, flexible strands of material 38 and bristles 32, as shown in FIG. 2. Alternatively, the bristles 32 could be slightly longer so that the bristles 32 extend slightly beyond the bonnet 32 to provide a multilevel cleaning surface (not shown).

To assemble the bonnet 22 and base member 24, the brush members 28 are positioned within the grooves 26 on the base member 24. The base member 24 is then mounted on the drive shaft of the electric motor 12 in a manner known to those skilled in the art. Then, the bonnet 22 is secured and positioned over the base member 24 with the bristles 32 of the brush member 28 extending through the openings 34, as shown in FIG. 2. However, as is understood by those skilled in the art, depending upon the type of rotary cleaning machine, the base member 24, brush members 28 and bonnet 22 can be first fully assembled and then the base member 24 can be mounted on the drive shaft of the electric motor 12.

As stated above, the bonnet 22 and base member 24 of the present invention are shown with the rotary cleaning machine 10 for illustration purposes only, as the bonnet 22 and base member 24 can be used in conjunction with any rotary floor and/or carpet cleaning machine of this general type. Furthermore, bonnet 22 and base member 24 can be of any suitable diameter to correspond to the particular cleaning machine requirements. Moreover, variations may be made in the relative size of the fibers or flexible sections of the bonnet and may even include patches of relatively stiff fibers or bristles 44, which are more or less like those of a hair brush, circumferentially attached about the periphery of the bonnet 22, as shown in FIGS. 2 and 4.

From the foregoing description, it can be seen that the present invention comprises a cleaning pad wherein the brush members and bonnet can be independently replaced. It will be appreciated by those skilled in the art that changes could be made to the embodiment described above without departing from the broad inventive concept thereof. It is understood, therefore, that this invention is not limited to the particular embodiment disclosed, but it is intended to cover all modifications which are within the spirit and scope of the invention as defined by the appended claims.

What is claimed is:

1. A combination of a bonnet and a base member for a rotary cleaning machine, said combination comprising.

a base member for attachment to a drive shaft of the rotary cleaning machine;

a brush member releasably positioned on said base member; and a bonnet constructed of flexible material including an opening extending therethrough and correspondingly sized and positioned to receive said brush member, said bonnet being positioned on said base member such that a portion of said brush member extends through said bonnet opening whereby a cleaning surface is formed by the combination of the brush member and bonnet and wherein the brush member and bonnet are independently replaceable.

2. The combination as recited in claim 1 wherein said brush member includes a back portion and a plurality of bristles extending outwardly therefrom and wherein said back portion is releasably secured to said base member.

3. The combination as recited in claim 1 wherein said bonnet is comprised of a bed of firmly looped flexible strands of material secured to a flexible backing material.

4. The combination as recited in claim 1 further including a plurality of brush members and a corresponding plurality of bonnet openings each bonnet opening being aligned with one of the brush members.

5. A combination of a bonnet and a base member for a rotary cleaning machine, said combination comprising:

a generally disk-shaped base member for attachment to a drive shaft of the rotary cleaning machine, said base member including a generally radially extending groove;

a brush member having a back portion thereof releasably positioned within said groove, said brush member includes a plurality of bristles extending outwardly from the back portion and from the base member;

a generally circular bonnet constructed of flexible material including a generally radial opening extending therethrough, the opening correspondingly sized and positioned to receive said bristles of said brush member therethrough, said bonnet being positioned on said base member such that said bristles extend through said opening whereby a cleaning surface is formed by the combination of the bristles and the bonnet and wherein the brush member and bonnet are independently replaceable.

6. The combination as recited in claim 5 wherein said bonnet is comprised of a bed of firmly looped flexible strands of material secured to a flexible backing material.

7. The combination as recited in claim 5 further including a plurality of radially extending grooves circumferentially spaced around the base member, a corresponding plurality of brush members, with one brush member positioned within each of the grooves and a corresponding plurality of bonnet openings, with each bonnet opening sized and positioned for receiving the bristles of a corresponding one of the brush members.

8. A combination of a bonnet and a base member on which the bonnet is positioned for use with a rotary cleaning machine, said combination comprising:

a generally disk-shaped base member for attachment to a drive shaft of the rotary cleaning machine, said base member including a generally radially extending groove;

a brush member including a back portion having bristles extending therefrom, said back portion being releasably positioned within said groove, with the bristles extending outwardly from the base member; and a generally circular bonnet formed of a bed of firmly looped flexible strands of material secured to a flexible backing material and further including a generally radial opening extending therethrough, the opening correspondingly sized and positioned to receive said bristles, said bonnet being positioned on and over said base member such that said bristles extend through said opening whereby a cleaning surface is formed by the firmly looped flexible strands of material and the bristles.

9. The combination as recited in claim 8 further including a plurality of radially extending grooves circumferentially spaced around the base member, a corresponding plurality of brush members, one of the brush members positioned within each of the grooves and a corresponding plurality of bonnet openings, each bonnet opening receiving the bristles of a corresponding one of the brush members.

10. A cleaning bonnet for rotary floor cleaning machines, said bonnet comprising a base sheet of material for attachment to the rotary floor cleaning machine to thereby form a first cleaning surface constructed of a first material, said base sheet of material including an opening therethrough, and a generally complementary cleaning member positioned within said opening to thereby form a second cleaning surface constructed of a second material, whereby two cleaning surfaces are formed by the base sheet of material and the cleaning member.

11. The cleaning bonnet as recited in claim 10 wherein said base sheet of material is generally circular and is constructed of a flexible material.

12. The cleaning bonnet as recited in claim 11 further including a bed of firmly looped, flexible strands of material secured to said base sheet of material.

13. The cleaning bonnet as recited in claim 10 wherein said opening extends generally radially and is correspondingly sized and located to receive said cleaning member therethrough.

14. The cleaning bonnet as recited in claim 10 further including a plurality of openings therein for receiving a corresponding plurality of cleaning members therethrough.

15. The cleaning bonnet as recited in claim 10, wherein said first cleaning surface and said second cleaning surface are generally coplaner.

16. A cleaning bonnet for rotary cleaning machines, said bonnet comprising a base sheet of material for attachment to the rotary floor cleaning machine to thereby form a first cleaning surface constructed of a first material, said base sheet of material including an opening therethrough, and a brush member positioned within said opening to thereby form a second cleaning surface constructed of a second material, said brush member including a back portion having bristles extending therefrom, said opening being correspondingly sized to receive said bristles therethrough whereby two cleaning surfaces are formed by the base sheet of material and the cleaning member.

* * * * *